US005195349A

United States Patent [19]

Ishinaga et al.

[11] Patent Number: 5,195,349

[45] Date of Patent: Mar. 23, 1993

[54] FORMING MACHINE AND PROCESS FOR FORMING MATERIAL THEREWITH

[75] Inventors: Nobuyuki Ishinaga; Takashi Nakano, both of Sagamihara, Japan

[73] Assignee: Aida Engineering Ltd., Kanagawa, Japan

[21] Appl. No.: 847,424

[22] Filed: Mar. 5, 1992

Related U.S. Application Data

[63] Continuation of Ser. No. 478,465, Feb. 12, 1990, abandoned.

[51] Int. Cl.[5] ..... B21J 9/12

[52] U.S. Cl. ..... 72/359; 72/355.2; 72/407

[58] Field of Search ..... 72/354.6, 354.8, 355.2, 72/355.4, 407, 359

[56] References Cited

U.S. PATENT DOCUMENTS

| | | | |
|---|---|---|---|
| 4,653,310 | 3/1987 | Urata et al. | 72/354 |
| 4,914,938 | 4/1990 | Ishinaga | 72/355.2 |
| 4,918,970 | 4/1990 | Ishinaga | 72/407 |
| 4,977,773 | 12/1990 | Mito et al. | 72/407 |

FOREIGN PATENT DOCUMENTS

| | | | |
|---|---|---|---|
| 88945 | 7/1980 | Japan | 72/354 |
| 106650 | 8/1980 | Japan | 72/354 |
| 59-199140 | 11/1984 | Japan | 72/355.2 |
| 30545 | 2/1985 | Japan | 72/354 |
| 645745 | 2/1979 | U.S.S.R. | 72/407 |
| 1047574 | 10/1983 | U.S.S.R. | 72/427 |

*Primary Examiner*—Robert L. Spruill
*Assistant Examiner*—Donald M. Gurley
*Attorney, Agent, or Firm*—Kalish & Gilster

[57] ABSTRACT

This invention relates to a forming machine used for full enclosed die forming etc. The forming machine of this invention consists of inserting a punch into at least one of a pair of dies disposed to face each other, supporting the die having the punch inserted therein by one end of a ring member accommodated in a holder, and disposing the other end of the ring member within a cylinder chamber formed within the holder; the above ring member has a piston member disposed within it, the above punch is supported by one end of the piston member, and the other end of the piston member is disposed in the above cylinder chamber formed within the holder or a cylinder chamber communicated with the holder. In the forming machine of the present invention, for example when a slide moves down, the upper die, lower die and ring member move down, and this lowering movement of the ring member pushes hydraulic fluid from the cylinder chamber into the cylinder chambers having the piston members disposed, thereby moving the piston members upward and the lower punch upward as well.

4 Claims, 10 Drawing Sheets

195
153
159
113
169
155
165
167
170
177
176
171
178
183
173
176
179
181
187
175

FORMING MACHINE AND PROCESS FOR FORMING MATERIAL THEREWITH

This application is a continuation of application Ser. No. 07/478,465, filed Feb. 12, 1990, now abandoned.

BACKGROUND OF THE INVENTION

1. Field of the Invention

This invention relates to a forming machine used for fully enclosed die forging etc.

2. Description of the Prior Art

Generally, a fully enclosed forming method in which a punch is inserted into at least one of a pair of dies to have the punch and the die relatively displaced, thereby deforming a material or a processing method for punching a material is being used extensively to reduce times of forming steps, produce complicated-shaped products, pierce without deforming the entire shape, and improve material yields.

For example, making a formed product 11 as shown in FIG. 12 (*a*) from a material 13 as shown in FIG. 12 (*b*) requires several steps when an ordinary swaging is applied. But, such steps can be reduced to one step by employing a forming method consisting of holding the material 13 with upper and lower dies 17, 19 and moving a punch 21 in the direction of arrow A FIG. (13).

The above step requires force to keep the upper and lower dies 17, 19 contacted or a closing force.

FIG. 14 shows a forming machine to effect the forming method of FIG. 13, in which reference numerals 17, 19 indicate upper and lower dies vertically disposed to face each other.

The upper die 17 is supported by an upper holder 25 which is fixed to an upper die set plate 23. The upper die 17 has an upper punch 27 inserted therein, which upper punch 27 has the bottom end of a knockout pin 29 contacted thereto.

The lower die 19 is supported by a ring member 33 through a ring 31. Both lower die 19 and ring member 33 having a lower punch 35 inserted therein.

Into the ring member 33 is inserted a column part 41 of a plate 39 which has its bottom end fixed to a lower die set plate 37.

The ring member 33 is disposed within a lower holder 43 which guides the ring member 33 to move vertically. This lower holder 43, the bottom end of the ring member 33 and the plate 39 form a cylinder chamber 45.

With the forming machine structured as described above, first a slide (not shown) lowers from a state illustrated in the left half of FIG. 14, the upper die 17, lower die 19 and ring member 33 lower as shown in the right half of FIG. 14, but the lower punch 35 moves relative to the lower die 19 because the lower punch 35 is fixed, and the material 13 is subjected to closed forming to produce the formed product 11.

This forming machine supplies hydraulic fluid into the cylinder chamber 45 to move the ring member 33 upward, and at the same time discharges the extra fluid outside through a relief valve 51 by the downward movement of the ring member 33, thereby providing the closing force for the upper die 17 and the lower die 19.

However, in such a conventional forming machine, the upper die 17 and the lower die 19 require the closing force much greater than required for closing, and a great slide stroke is required, thus causing a disadvantage of increasing the required workload of the press.

More specifically, to produce the formed product 11 as shown in FIG. 12 (*a*) for example, the closing force required at a bottom dead center becomes maximum as shown in FIG. 15, so that the closing force is required to be set based on the bottom dead center. Load $P_F$ of the lower punch 19 varies as shown by a dotted line with respect to the moving slide, and the closing force given is much greater than required until the slide reaches about the bottom dead center. And the ring member 33 needs a stroke $S_1$ as shown in FIG. 14, requiring workload corresponding to the area of the section enclosed by slant lines as shown in FIG. 15.

As a result, a press with greater torque capacity is needed, and the energy required for forming increases.

Besides, since the upper and lower dies 17, 19 start contacting at a position much higher than the bottom dead center, automated parts have inferior approach in automated production, and a press with a long slide stroke is required.

Further, forming an excessively voluminous material may damage the dies, and the upper and lower dies 17, 19 do not contact each other, resulting in having difficulty in securing a prescribed-sized formed product 11.

A forming machine similar to the one described above is known disclosed in Japanese Patent Publication No. 56-21498. This machine is fixed to a mechanical press, and each hydraulic pressure supplying device is disposed outside of the forming machine, requiring troublesome work for replacement of dies, maintenance, etc. with inferior flexibility to be applied to make various formed products.

SUMMARY OF THE INVENTION

An object of this invention is to provide a forming machine capable of preventing excess application of a closing force.

Another object of this invention is to provide a forming machine which is capable of extensively lowering a closing force and a slide stroke as compared with conventional ones, is easy to maintain or replace dies, and is excellent in flexibility to various formed products.

DESCRIPTION OF THE PREFERRED EMBODIMENT OF THE INVENTION

Now, the present invention will be described in detail with reference to the attached drawings.

Figure 1:
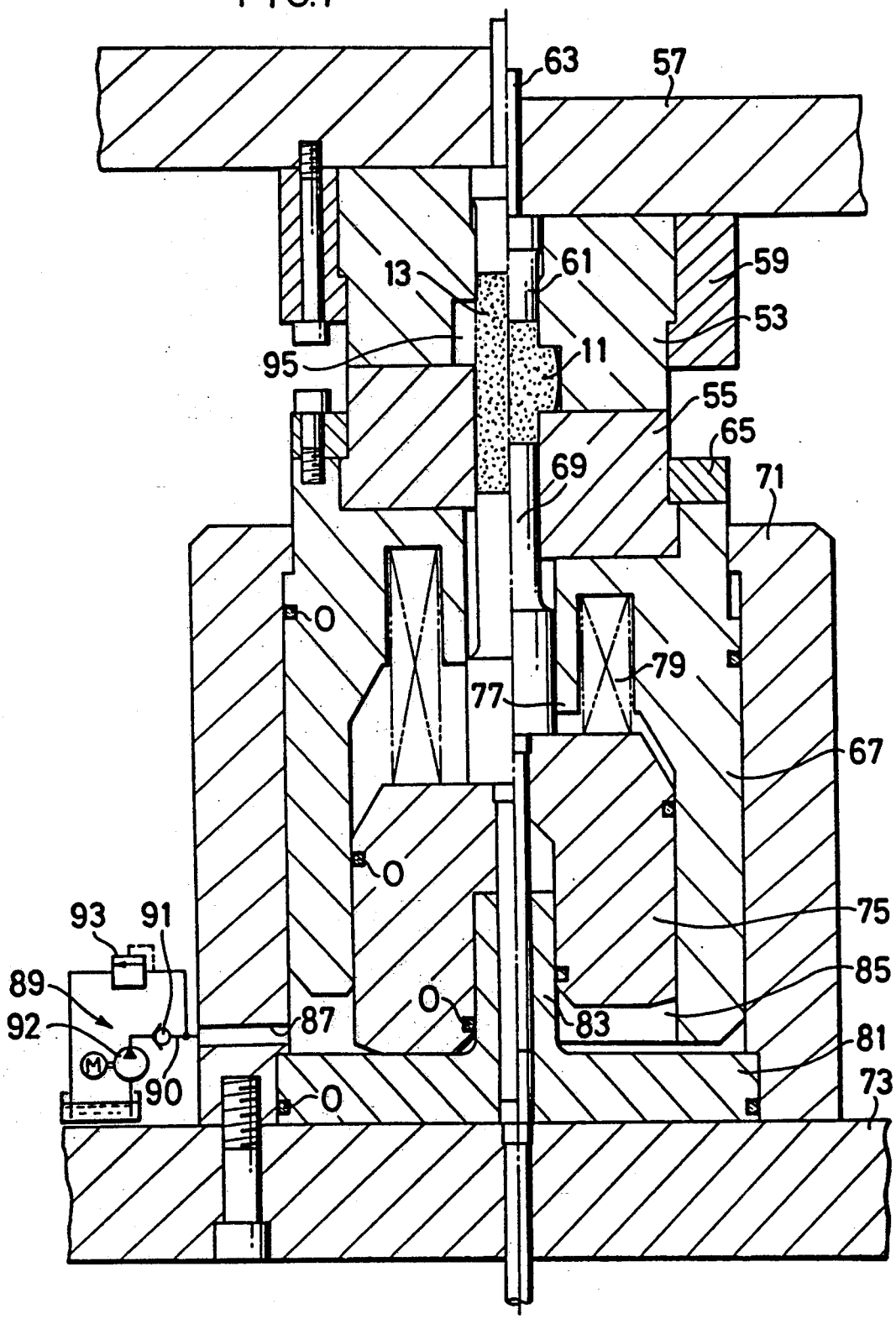
FIG. 1 is a longitudinal sectional view showing the first embodiment of a forming machine of the present invention.

FIG. 1 shows one embodiment of a forming machine of this invention; the left half showing a condition of the material 13 prior to forming and the right half showing the material 11 after forming.

Reference numerals 53, 55 indicate upper and lower dies vertically disposed to face each other.

The upper die 53 is supported by an upper holder 59 fixed to an upper die set plate 57 and has an upper punch 61 inserted therein. This upper punch 61 has the bottom end of a knockout pin 63 contacted thereto.

The ring member 67 is disposed within a lower holder 71 which guides the ring member 67 to vertically move freely. The bottom end of the lower holder 71 is fixed to a lower die set plate 73.

In this embodiment, within the ring member 67 is disposed a piston member 75 to be freely movable vertically, and the top of the piston member 75 supports the bottom end of the lower punch 69.

A member 77 formed between the upper part of the ring member 67 and the upper surface of the piston member 75 have a spring 79 disposed to move the piston member 75 downward.

Into the piston member 75 is inserted the column section 83 of a plate 81 whose bottom end is fixed to the lower die set plate 73.

The piston member 75, the bottom end of the ring member 67 and the plate 81 form a cylinder chamber 85.

The lower holder 71 is provided with a through hole 87 communicated to the cylinder chamber 85. The through hole 87 is connected with a pipe 90 which is connected to a hydraulic fluid supply device 89. This pipe 90 is provided with a check valve 91 and a hydraulic pump 92, and a relief valve 93 is disposed downstream from the check valve 91. Elements 89 through 93 are shown schematically in FIG. 1.

Mark O in the drawing indicates an oil seal, and in this embodiment, the lower end area of the ring member 67 has an area S (not shown) equal to that of the bottom end of the piston member 75.

Figure 2:
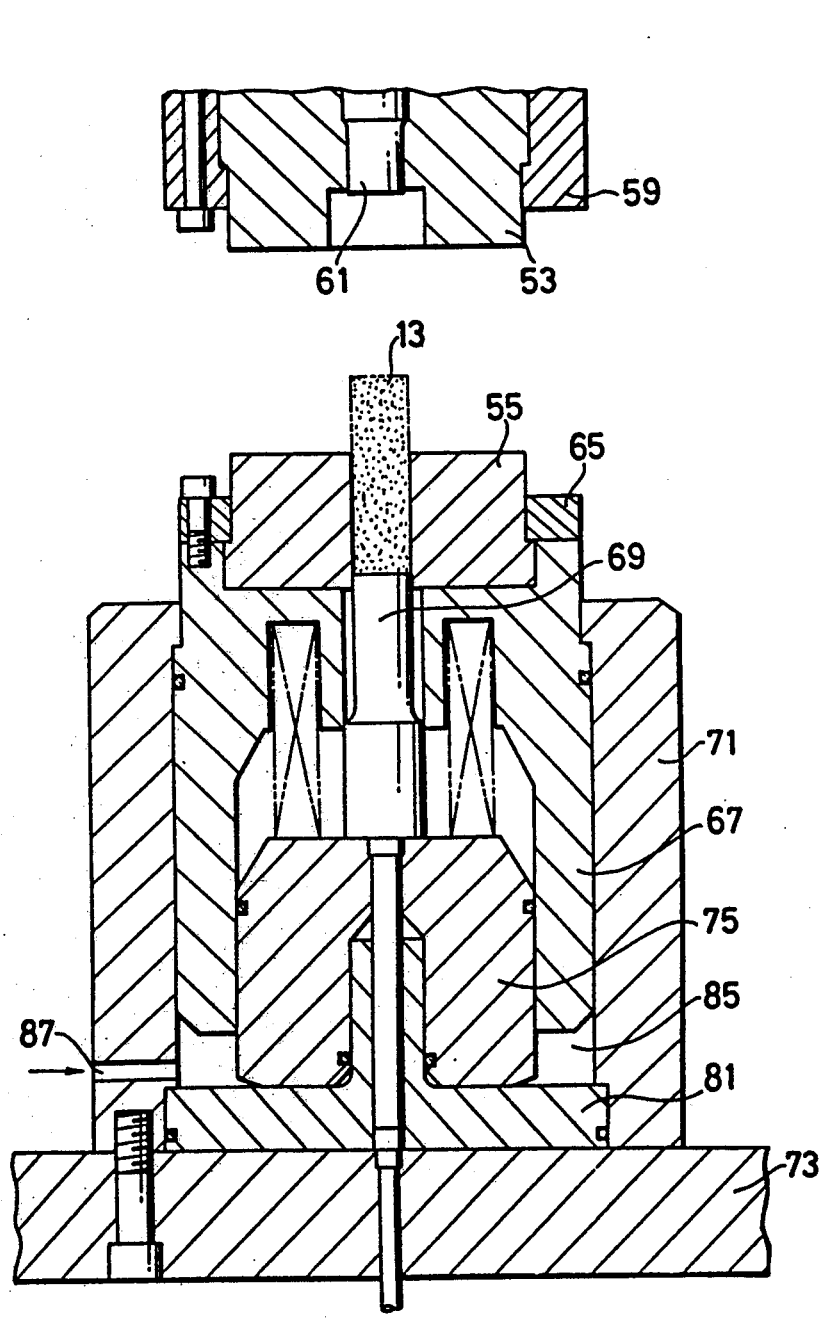
FIG. 2 is a longitudinal sectional view showing a condition that a material is supplied to the forming machine of FIG. 1.

In the forming machine structured as described above, as shown in FIG. 2, with the cylinder chamber 85 filled with hydraulic fluid, a slide (not shown) moves downward and the upper die set plate 57 (see FIG. 1) lowers to move the upper die 53, the lower die 55 and the ring member 67 down, and this downward movement of the ring member 67 pushes the hydraulic fluid within the cylinder chamber 85 against the piston member 75, thereby moving the piston member 75 and the lower punch 69 upward.

The forming machine structured as described above allows the closing force and slide stroke to be extensively lower than in conventional forming machines by disposing the piston member 75 within the ring member 67, supporting the lower punch 69 by one end of the piston member 75, positioning the other end of the piston member 75 within the cylinder chamber 85 formed in the lower holder 71, and providing the bottom end area of the ring member 67 and that of the piston member 75 with the same area S.

Figure 3:
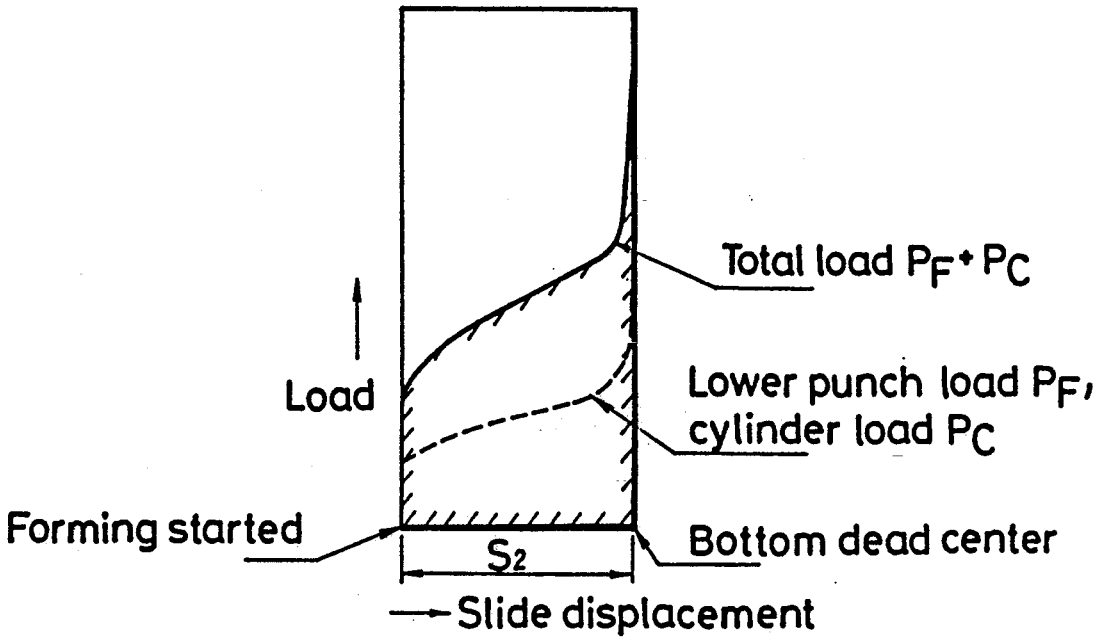
FIG. 3 is a graph showing the relation between slide displacement and load of the forming machine of FIG. 1.
Figure 12B:
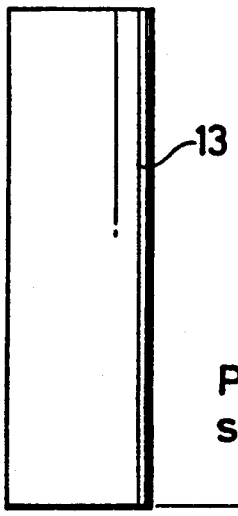
FIG. 12(*a*) is a side elevation view of one embodiment of a formed product and FIG. 12(*b*) is an elevation view of a material blank from which the product of FIG. 12(*a*) is formed.
Figure 12A:
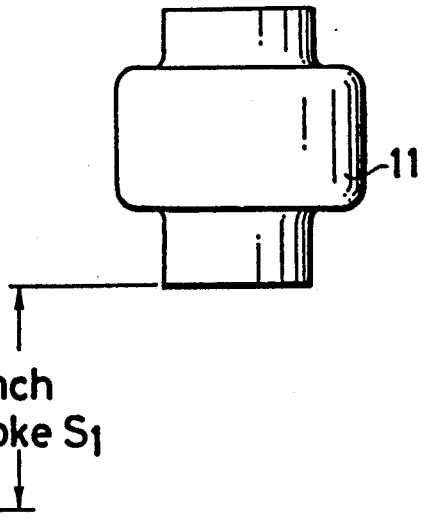

Specifically, the forming machine structured as above can reduce the sliding stroke required for forming by causing the bottom end area of the ring member 67 and that of the piston member 75 to have the same area S; the ring member 67 lowers by a distance $S_2$ and the piston member 75 moves upward by the same distance $S_2$, and the slide stroke required to produce the product 11 as shown in FIG. 12 (*a*) is approximately one half of the conventional stroke, as shown by the dotted line in FIG. 3.

And, in the above forming machine, the bottom end area of the ring member 67 and that of the piston member 75 are formed to have the same area S, so that the load required to lower the lower die 55 by the closing force asserted by upper die 53 agrees with the load $P_F$ of the lower punch and varies with the degree of filling of the material 13 into a cavity 95. Therefore, there is no application of excess closing force, unlike the conventional forming machines.

Thus, it is possible to cause the closing force for closing the upper and lower dies 53, 55 to be an appropriate value according to the forming condition, and since the slide stroke required for forming becomes short, energy required for forming can be reduced.

As a result, forming can be effected by using a press with a small torque capacity, and a press with a short slide stroke can be employed for automated production.

Because the upper and lower dies 53, 55 are not contacted by the forming force much greater than required, the service life of these dies 53, 55 can be extended.

In the forming machine structured as described above, hydraulic pressure is generated within the cylinder chamber 85 by the forming load of the lower punch 69, eliminating the usual necessity of providing a large external hydraulic pressure supplying device. The hydraulic fluid supply device 89 is sufficiently provided to supply the hydraulic fluid.

In this embodiment, the hydraulic fluid supply device 89 is provided with the relief valve 69 for adjusting the set pressure so as to make it possible to set the forming load of the lower punch 69 at about the bottom dead center, eliminating a possible damage to the dies in case of forming an excessively voluminous material.

In this case, at the end of a first forming a portion of the hydraulic operating fluid in the cylinder chamber 85 is discharged outside through the relief valve 93 to move the press slide upward. And by the time the next forming starts, the hydraulic operating fluid is supplied into the cylinder chamber 85 by the hydraulic fluid supplying device 89 to cause the hydraulic operating fluid in the cylinder chamber 85 to be a prescribed amount.

In addition, in the forming machine structured as described above, almost all of the components of the forming machine can be accommodated in the die set, making the entire size to be very small. Therefore, it is very easy to replace or maintain the upper and lower dies 53, 55, the upper and lower punches 61, 69, allowing the replacement of the entire machine in a short time.

It is also very easy to replace the ring member 67 and the piston member 75. These members can be replaced to easily vary the ratio of the closing force and the forming load (lower punch load) by controlling the volume of fluid displaced thereby. Thus, the present machine is superior in adaptability to produce many various formed products.

The above embodiment includes spring 79 to move the piston member 75 down, but this invention is not limited to the above embodiment. For example, a hydraulic, pneumatic, or any cylinder may be used to move the piston member 75.

In the above embodiment, an example of forming the product shown in FIG. 12 (*a*) was described, but this invention is not limited to that embodiment. For example, it becomes possible to easily form gears, etc. by forming a cavity in the shape of a gear or the like.

Further, the above embodiment described an example of providing the cylinder chamber 85 below the lower die 55, but this invention is not limited to that embodiment. For example, the machine may be designed upside down to dispose the cylinder chamber 85 on the slide side, and the dies may be horizontally disposed to face each other.

Besides, the above embodiment described an example having the bottom end area of the ring member 67 and piston member 75 the same, but this invention is not limited to that embodiment. The bottom end area of the ring member 67 and piston member 75 can be varied based on the shape of a product to be formed, so that forming can be effected by an optimum closing force.

Figure 4:
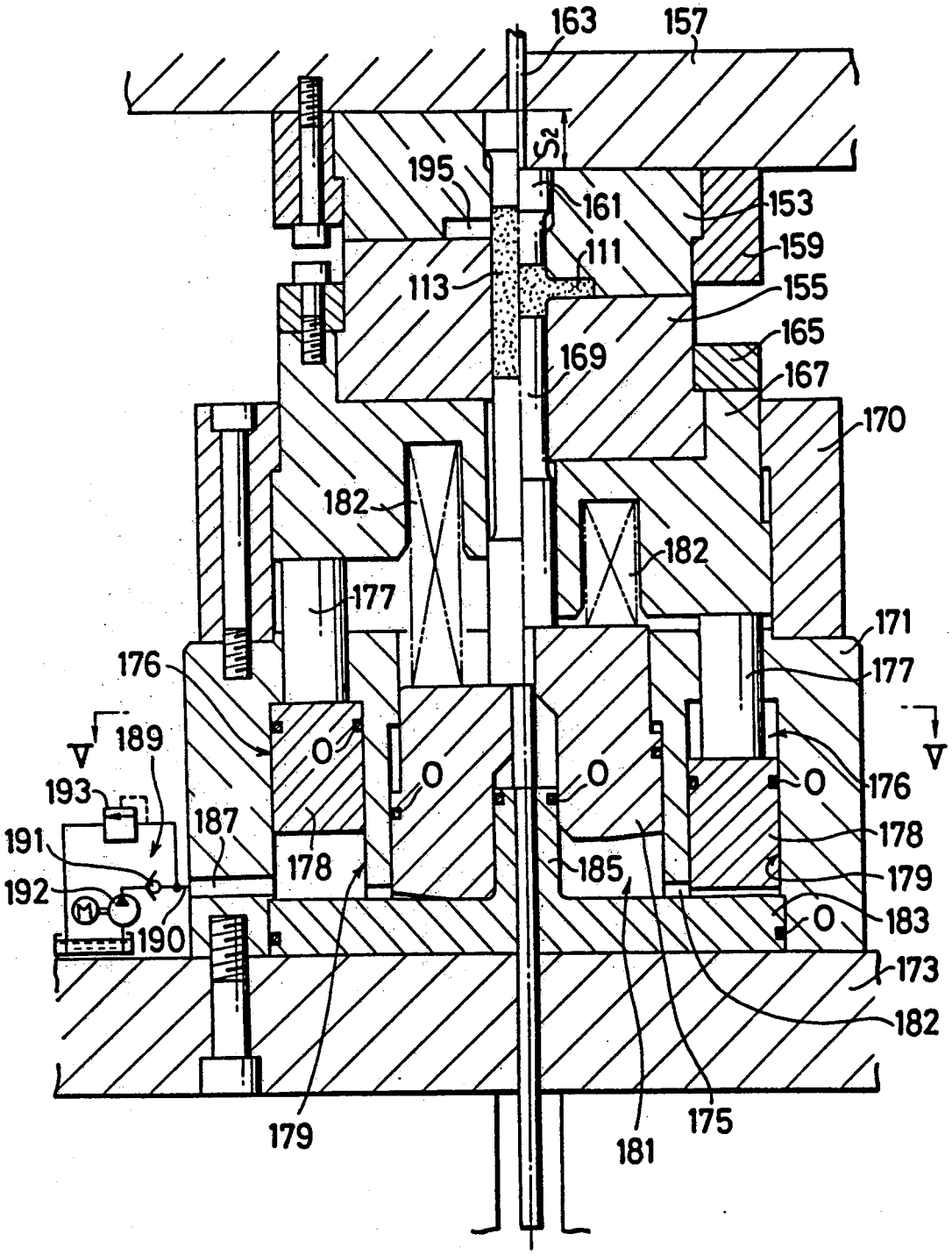
FIG. 4 is a longitudinal sectional view showing the second embodiment of the forming machine of this invention.

FIG. 4 shows the second embodiment of the forming machine of this invention, in which the left half shows a state before forming a material 113 and the right half, after forming.

In the drawing, reference numerals 153, 155 show upper and lower dies Vertically disposed to face each other.

The upper die 153 is supported by an upper holder 159 which is fixed to an upper die set plate 157 and has an upper punch 161 inserted therein. The upper punch 161 is in contact with the bottom end of a knockout pin 163.

The lower die 155, on the other hand, is supported by a die plate 167 through a ring 165. The lower die 155 and die plate 167 have a lower punch 169 inserted therein.

The die plate 167 is disposed within a guide 170 which guides the die plate 167 to vertically move freely. The bottom end of the guide 170 is fixed to the top of a holder 171.

The bottom end of the holder 171 is fixed to a lower die set plate 173.

In the above embodiment, the holder 171 is provided at its center with a piston member 175 which supports the lower punch 169.

Around the piston member 175 of the holder 171 are disposed a plurality of two-part piston members 176 which support the die plate 167.

Figure 5:
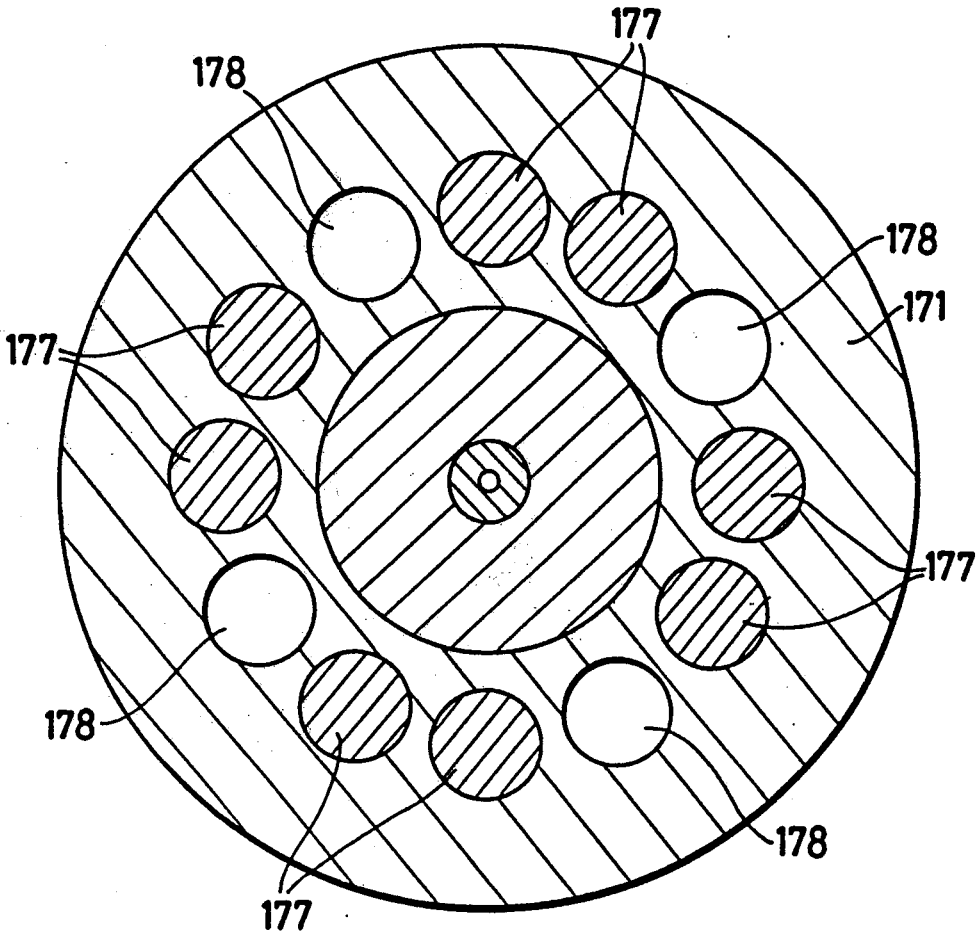
FIG. 5 is a transverse sectional view taken on line V—V of the forming machine of FIG. 4.
Figure 7:
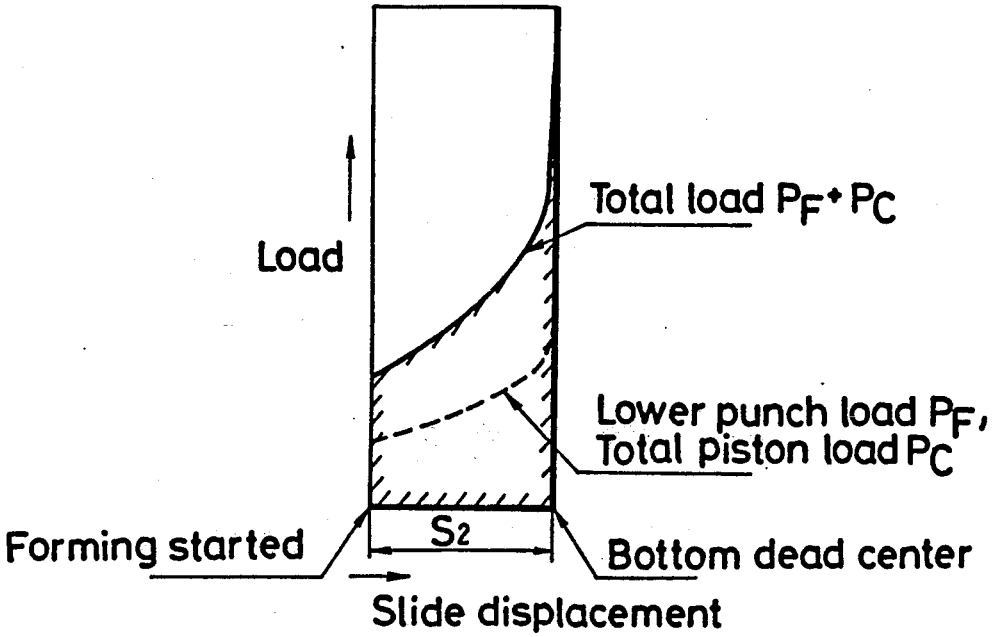
FIG. 7 is a graph showing the relation between slide displacement and load of the forming machine of FIG. 4.

These two-part piston members 176 consist of a pin 177 and a piston 178. As shown in FIG. 5, these two-part piston members 176 are disposed at the prescribed angle on the same circumference of a circle and are accommodated in cylinder chambers 179 which are integrally formed with the holder 171.

In this embodiment, 12 cylinder chambers 179 are formed to accommodate the pistons 178, and only 8 pins 177 are disposed as indicated by the hatched lines (FIG. 5). This means that there are 8 two-part piston members 176.

FIG. 4 shows that holder 171 is provided with a through hole 187 communicated to the cylinder chamber 179. The through hole 187 is connected with a pipe 190 which is connected to a hydraulic fluid supply device 189 This pipe 190 is provided with a check valve 191 and a hydraulic pump 192, and a relief valve 193 is disposed downstream the check valve 191. Parts 189 through 193 are shown schematically for simplicity.

Mark O in the drawing indicates an oil seal, and in this embodiment, the lower end area of the cylinder chamber 181 accommodating the piston member 175 has an area S equal to the total of all bottom end areas of the cylinder chambers accommodating the two-part piston members 176. This means that the lower end area of one cylinder chamber 179 to the bottom end area S of the cylinder chamber 181 is 1/8S.

Figure 6:
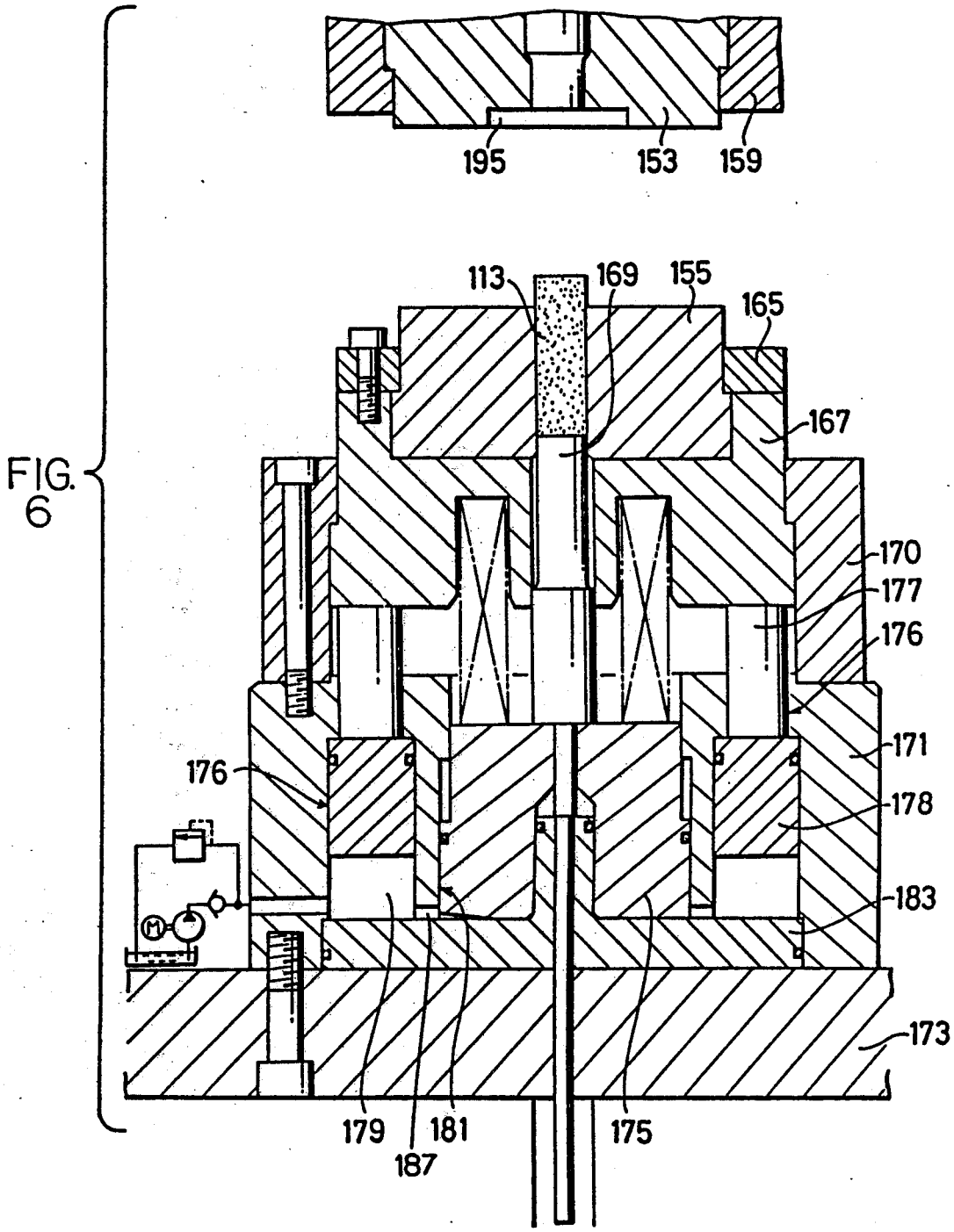
FIG. 6 is a longitudinal sectional view showing a condition that a material is supplied to the forming machine of FIG. 4.

In the forming machine structured as described above, as shown in FIG. 6, with the cylinder chambers 179, 181 fill ®d by the hydraulic fluid, the slide moves down and the upper die set plate 157 lowers to move the upper die 153, lower die 155 and die plate 167 downward. This downward movement of the die plate 167 causes the two-part piston members 176 to push the hydraulic fluid from the cylinder chambers 179 into the cylinder chamber 181 for the piston member 175, thereby moving the piston member 175 upward and the lower punch 169 upward too.

The forming machine structured as described above consists of a pair of the upper and lower dies 153, 155 disposed to face each other, the lower punch 169 to be inserted in the lower die 155, the die plate 167 to support the lower die 155 in which the lower punch 169 is inserted, the holder 171 disposed outwardly of the lower die 155 of the die plate 167, the piston member 175 to support the lower punch 169 disposed at the center of the holder 171, a plurality of the two-part piston members 176 to support the die plate 167 disposed outside of the piston member 175 of the holder 171, and a communication path 187 communicating the cylinder chamber 181 accommodating the piston member 175 with the cylinder chambers 179 accommodating the two-part piston members 176. And the bottom end area of the cylinder chamber 181 accommodating the piston member 175 has an area S which is same to the total of the bottom end areas of the cylinder chambers 179 accommodating the two-part piston members 176, enabling a greater decrease in the closing force and slide stroke as compared with the conventional ones.

In other words, the forming machine structured as described above has the bottom end area of the cylinder chamber 181 accommodating the piston member 175 made to have an area S which is same to the total area of the bottom end areas of the cylinder chambers 179 accommodating the two-part piston members 176, so that when the die plate 167 and the two-part piston members 176 move downward by a distance $S_2$, the piston member 175 moves upward by the same distance $S_2$. Therefore, the slide stroke required for the production of the formed product 111 as shown in FIG. 4 is a half of the conventional stroke, enabling a greater decrease in the slide stroke than before.

Since the forming machine structured as described above has the bottom end area of the cylinder chamber 181 accommodating the piston member 175 made to have an area S which is same to the total area of the bottom end areas of the cylinder chambers 179 accommodating the two-part piston members 176, the load required to move the lower die 155 down by the upper die 153 or the closing force agrees with the load $P_F$ of the lower punch 169 and varies according to the amount of the material 113 filled into a cavity 195, so that it is not necessary to keep the closing force much greater than required to be applied constantly as in the conventional machine.

This is because that the force required to close the upper die 153 and the lower die 155 becomes small, and the slide stroke for forming is shortened, reducing the required work to be done by the press and the energy required for forming.

As a result, forming can be done by a press with a small torque capacity and also by a press with a short slide stroke for automated production.

Since the upper and lower dies 153, 155 do not contact each other by an excessive closing force the service life of the upper and lower dies 153, 155 is extended.

Besides, the forming machine structured as described above employs the forming load of the lower punch 169 to generate the hydraulic pressure in the cylinder chamber 181, eliminating the necessity of externally providing a large size hydraulic pressure supply device unlike the conventional machines. It is sufficient by simply disposing the hydraulic fluid supply device 189 which supplies the hydraulic fluid.

In this embodiment, the hydraulic fluid supply device 189 is provided with a relief valve 193, whose specified pressure can be adjusted to set the forming load of the lower punch 169 at about the bottom dead center, and excessively voluminous material can be formed without damaging the dies.

In this case, at the end of forming, portion of the hydraulic operating fluid in the cylinder chamber 179 is discharged outside through the relief valve 193 to move the press slide upward. And by the time the next forming starts, the hydraulic operating fluid is supplied into the cylinder chamber 179 by the hydraulic fluid supplying device 189 to fill the cylinder chambers 179, 181 to a prescribed amount with the hydraulic operating fluid.

In addition, in the forming machine structured as described above, almost all of the components of the forming machine can be accommodated in the die set, causing the entire size to be very small. Therefore, it is very easy to replace or maintain the upper and lower dies 153, 155 and the upper and lower punches 161, 169, etc., allowing the replacement of the entire machine in a short time.

It is also very easy to attach or detach the pins 177 of the two-part piston members 176 to or from the holder 171, and these pins 177 can be disposed differently to easily vary the ratio $\eta$ of the closing force and the forming load (lower punch load). Thus, the present machine is superior in adaptability to produce many various formed products.

This is to say that the ratio $\eta$ is determined by the used number n of the pins 177 and can be easily varied by changing the used number n of the pins 177.

In the embodiment described above, as shown in FIG. 5, the holder 171 is provided with 12 cylinder chambers 179, and the sectional area of each cylinder chamber 179 is a value obtained by dividing the sectional area of the cylinder chamber 181 accommodating the piston member 175 by 8.

Therefore, as in the embodiment described above, it becomes easy to make $\eta$ to be 1 by using eight pins 177.

To make n to be 2, the cylinder chambers 179 are desirably disposed to face each other at an angle of 120°, and to set the n to 3, three cylinder chambers 179 are desirably disposed at an angle of 120°.

Figure 8:
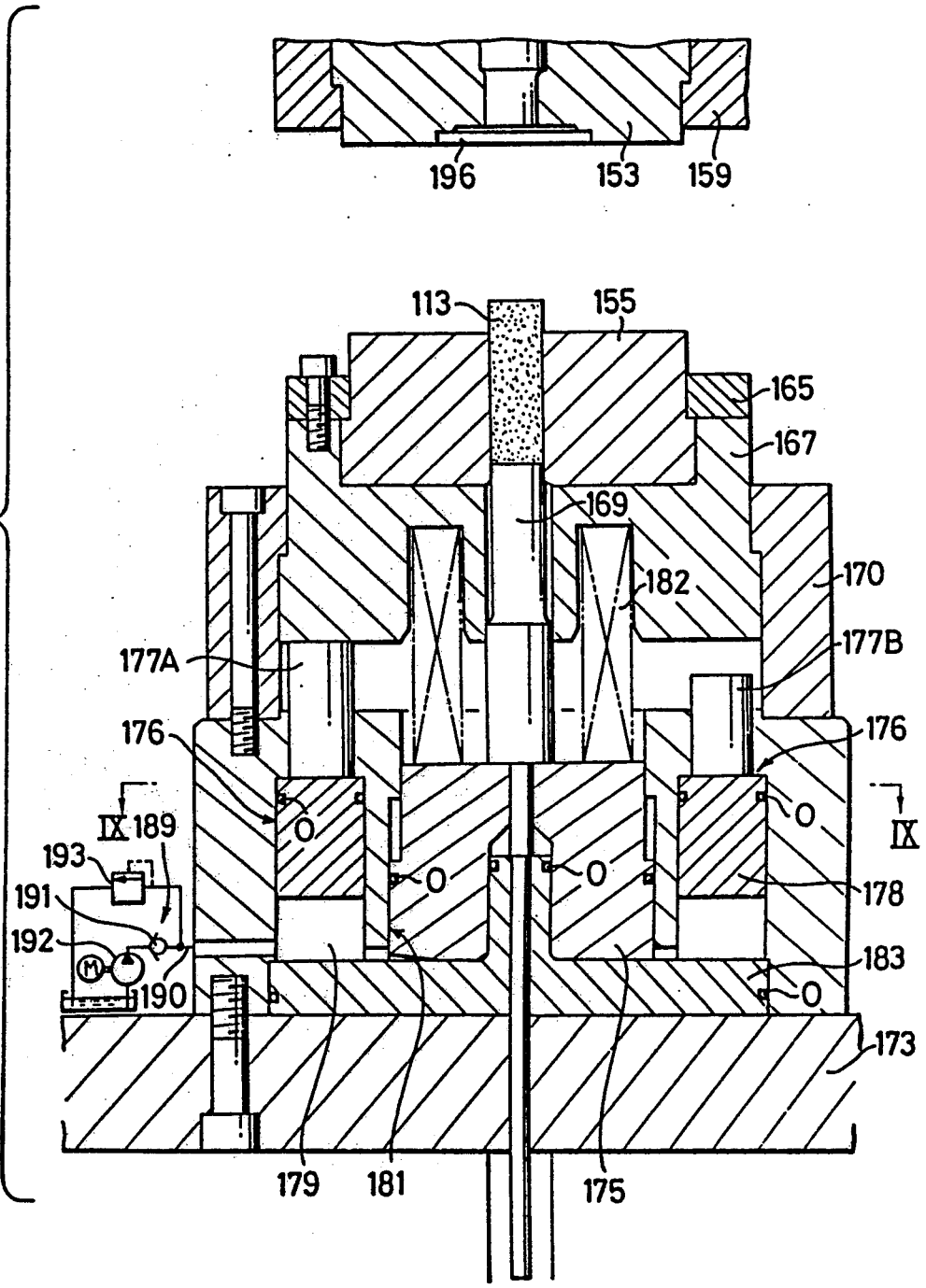
FIG. 8 is a longitudinal sectional view showing the third embodiment of the forming machine of this invention.

FIG. 8 shows the third embodiment of the forming machine of this invention, which is basically the same as the second embodiment. In this embodiment, two types of pins 177A, 177B different in length are used instead of the pins 177 comprising the two-part piston members 176.

Figure 9:
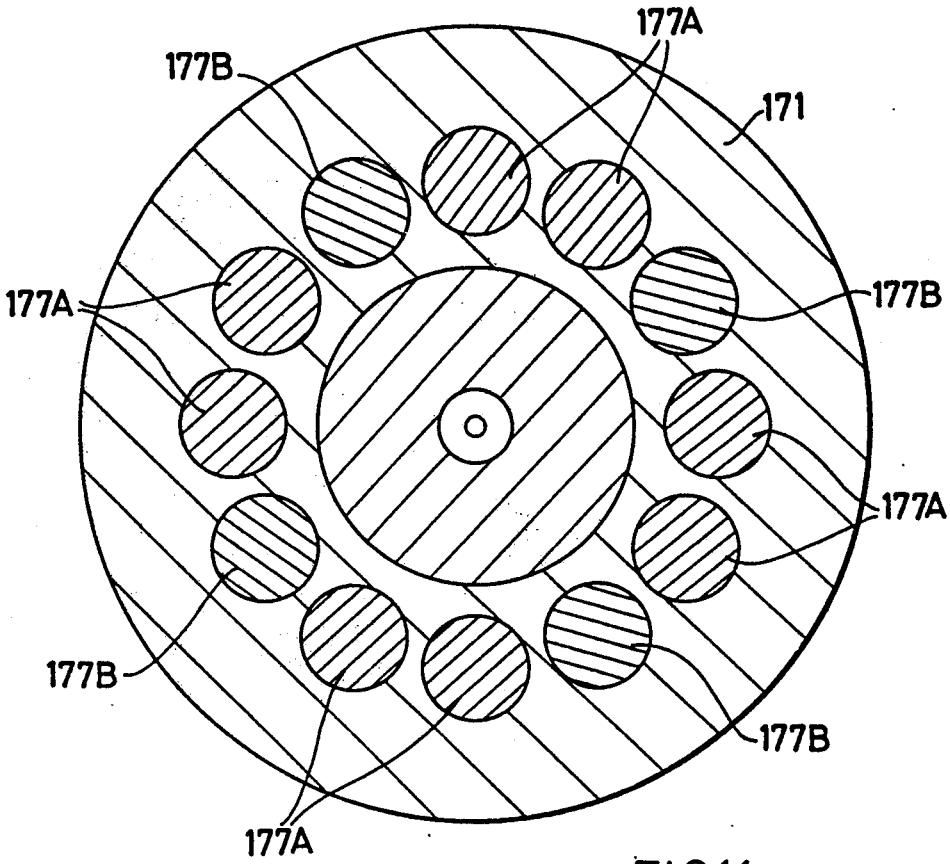
FIG. 9 is a transverse sectional view taken on line IX—IX of the forming machine of FIG. 8.

The long pins 177A are designed to contact the die plate 167 at the beginning of forming and used in a set of eight as shown in FIG. 9. Consequently, the value $\eta$ is 1 then.

The short pins 177B are designed to contact the die plate 167 on the way to forming and used in a set of four as shown in FIG. 9. Consequently, when these pins 177B contact with the die plate 167, the value $\eta$ is 1.5

Figure 10:
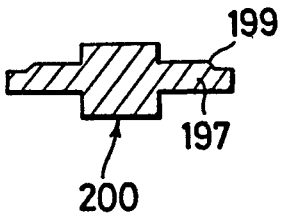
FIG. 10 is a longitudinal sectional view showing a product formed by the forming machine of FIG. 8.

In this embodiment, a cavity 196 is formed in the upper die 153, and a formed product 200 having a flange 199 with an uneven-leveled part 199 is formed as shown in FIG. 10.

Figure 11:
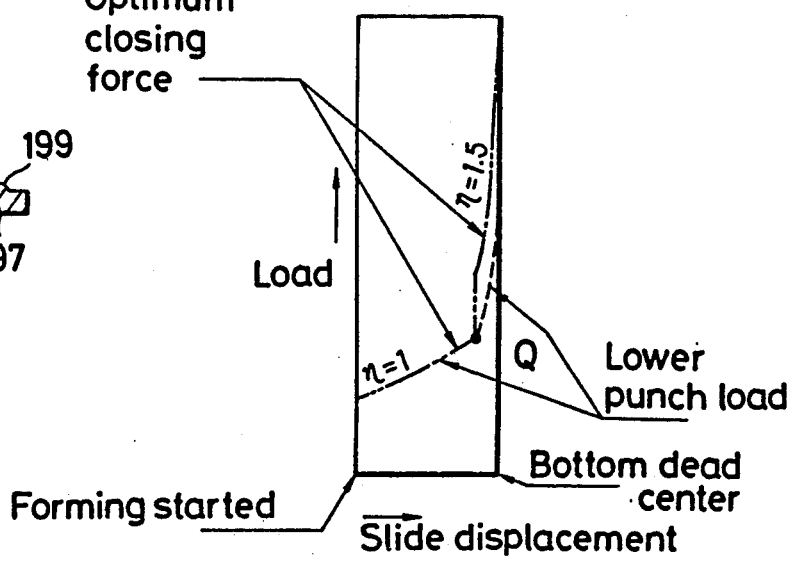
FIG. 11 is a graph showing the relation between slide displacement and load of the forming machine of FIG. 8.
Figure 13:
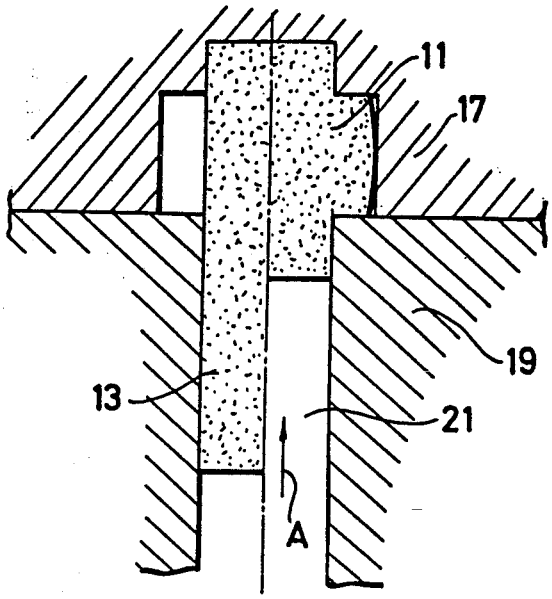
FIG. 13 is an explanatory view showing a fully enclosed forming method.
Figure 15:
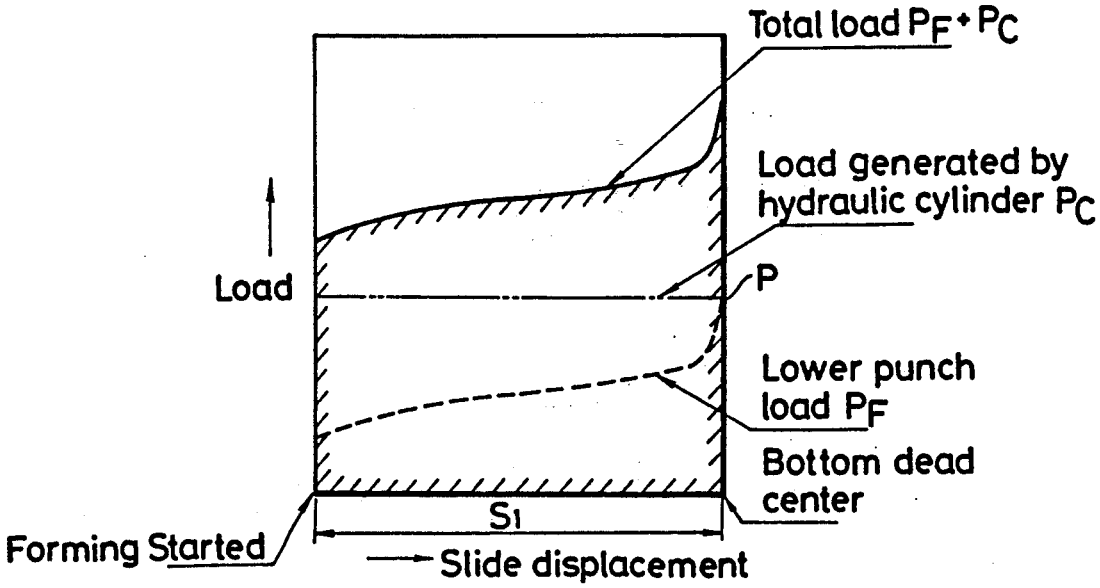
FIG. 15 is a graph showing the relation between slide displacement and load of the forming machine of FIG. 14.
Figure 14:
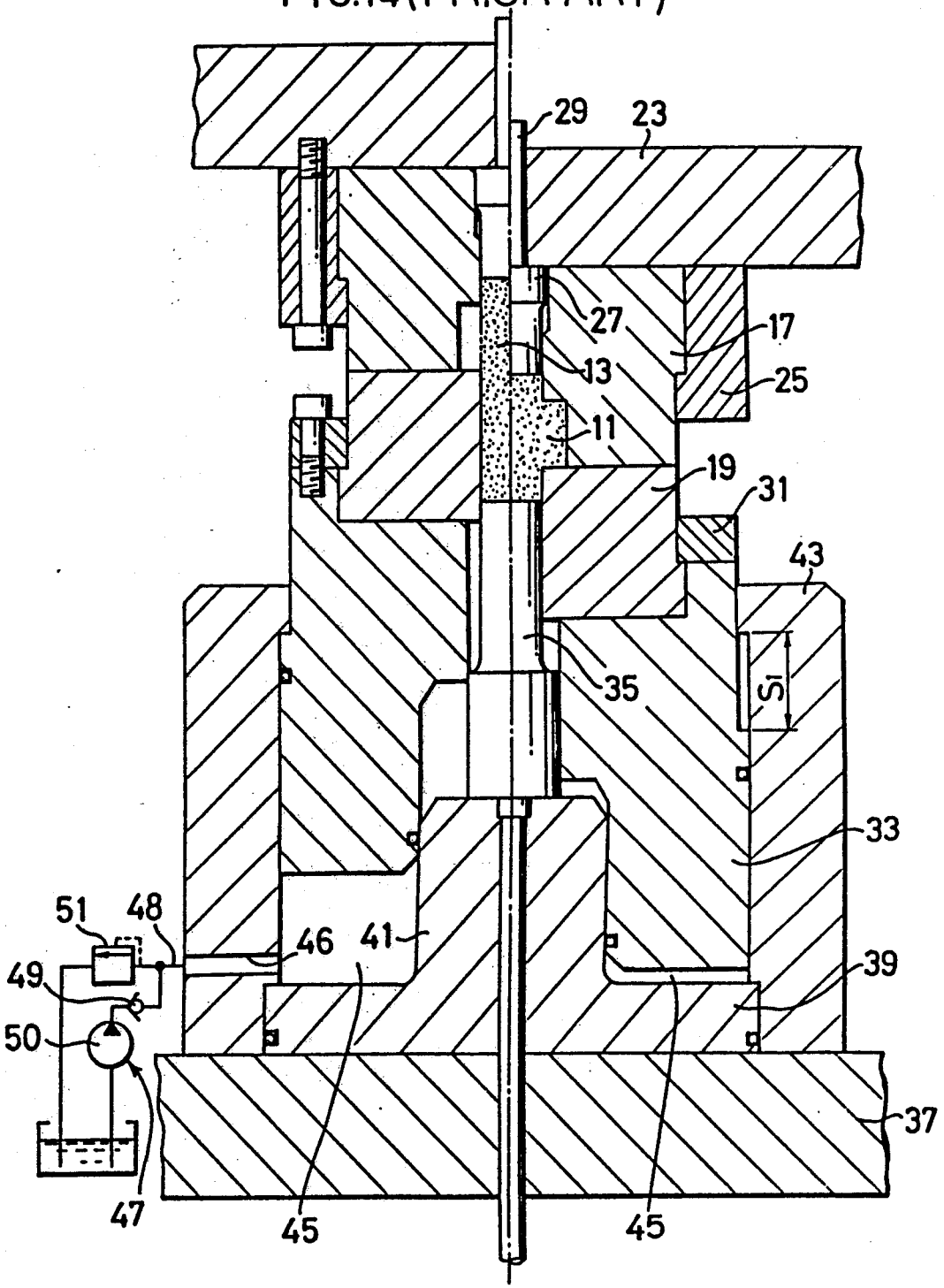
FIG.14 (PRIOR ART)
FIG. 14 is a longitudinal sectional view showing one embodiment of a conventional forming machine.

In the formed product 200 as shown in FIG. 10, it is desirable to vary the value $\eta$ from 1 to 1.5 during load application Q of forming as shown in FIG. 11, and this embodiment makes it possible to easily vary the value $\eta$ during load application Q of forming.

With the forming machine structured as described above, almost the same effect can be attained as by the embodiment shown in FIG. 4.

In the third embodiment, the piston member 175 is forced down by the spring 182, but this invention is not limited to such an embodiment. For example, the piston member 175 may be energized by a hydraulic, pneumatic or any other cylinder.

Further, in the above embodiment, the formed product 200 as shown in FIG. 10 is produced, but this invention is not limited to such an embodiment. For example, it becomes possible to easily form gears and the like by forming the cavity in a corresponding shape.

In the above embodiment, the die plate 167 is disposed below the lower die 155. But this invention is not limited to such an embodiment. For example, the machine may be designed upside down to dispose the die plate 167 on the slide side, and the dies may be horizontally disposed to face each other.

As many apparently widely different embodiments of this invention may be made without departing from the spirit and scope thereof, it is to be understood that the invention is not limited to the specific embodiments thereof except that as defined in the appended claims.

What is claimed is:

1. A forming machine for providing selective variation of the ratio $\eta$ of a closing force to a forming force, comprising a pair of dies disposed to face each other, a punch partially inserted in at least one of the dies, a die plate supporting one of the dies in which the punch is inserted, a guide member disposed outwardly of the die on the die plate and confining the die plate for axial movement within said guide member, means for driving the dies together to develop the closing force, a piston member supporting the punch for axial movement therewith and disposed at the center of a holder located beneath the guide member, the piston member disposed for driving the punch further into said one die to develop the forming force, a plurality of two-part piston members within said holder supporting the die plate and disposed radially outwards of the piston member, and a communication path communicating between a first fluid pressurized cylinder chamber accommodating the piston member and a second fluid cylinder chamber accommodating each of the two-part piston members for increasing fluid pressure within said first chamber as the dies move together in the same direction toward the two part piston members, the two-part piston members providing displacement of fluid from the second chamber to the first chamber through said communication path for forcing the punch via the piston member further into said one die in response to such fluid pressure increase for developing the forming force on said punch, the number of complete two-part piston members being selectively variable for controlling volume of the fluid displacement thereby to selectively vary the ratio $\eta$.

2. The forming machine of claim 1 wherein the two-part piston members each comprise a pin and a piston which are selectively and independently removable to create variations in the ratio $\eta$.

3. The forming machine of claim 3 wherein each pin of each two-part piston member is variable in length to create variations in the ratio $\eta$.

4. The forming machine of claim 1 wherein one-half of the forming machine, as defined on one side of a plane which is created by the intersection of the surfaces of the two dies in the closed position, is asymmetric to the other half of the forming machine, and wherein the ratio $\eta$ is controlled by asymmetric variation of the application of forming force through only one such half of the forming machine.

* * * * *

UNITED STATES PATENT AND TRADEMARK OFFICE

CERTIFICATE OF CORRECTION

PATENT NO. : 5,195,349

DATED : March 23, 1993

INVENTOR(S) : Ishinaga et al

It is certified that error appears in the above-identified patent and that said Letters Patent is hereby corrected as shown below:

Column 6, line 26, replace

"fill ®d" with --filled--.

In the Claims, Claim 3, column 10, line 7, replace

"claim 3" with --claim 2--.

Signed and Sealed this

Seventh Day of December, 1993

*Attest:*

*Attesting Officer*

BRUCE LEHMAN

*Commissioner of Patents and Trademarks*